United States Patent [19]

Hisamoto et al.

[11] Patent Number: 4,563,287

[45] Date of Patent: Jan. 7, 1986

[54] AQUEOUS FIRE-EXTINGUISHING COMPOSITION

[75] Inventors: Iwao Hisamoto, Osaka; Chiaki Maeda; Takasige Esaka, both of Kyoto; Masaru Hirai, Osaka, all of Japan

[73] Assignee: Daikin Kogyo Co., Ltd., Osaka, Japan

[21] Appl. No.: 523,601

[22] Filed: Aug. 16, 1983

[30] Foreign Application Priority Data

Aug. 16, 1982 [JP] Japan ..... 57-142443

[51] Int. Cl.[4] ..... A62D 1/00

[52] U.S. Cl. ..... 252/2; 169/46; 169/65

[58] Field of Search ..... 252/2, 44, 3, 8.05, 252/308, 306; 169/65, 46; 526/246, 248, 250, 253, 254

[56] References Cited

U.S. PATENT DOCUMENTS 3,080,347 3/1963 Sandberg ..... 260/80.5
3,475,333 10/1969 Meldrum et al. ..... 252/3
3,562,156 2/1971 Francen ..... 252/3
3,919,183 11/1975 Jager ..... 260/86.1 R
3,944,527 3/1976 McCown ..... 260/79.7
4,171,282 10/1979 Mueller ..... 252/8.05
4,303,534 12/1981 Hisamoto et al. ..... 252/3
4,420,434 12/1983 Falk ..... 252/2

*Primary Examiner*—Stephen J. Lechert, Jr.
*Assistant Examiner*—Howard J. Locker
*Attorney, Agent, or Firm*—Birch, Stewart, Kolasch & Birch

[57] ABSTRACT

An aqueous fire-extinguishing composition comprising an aqueous solvent and a water-soluble high molecular compound which contains a fluoroalkyl group and a water-solubilizable group, has an average molecular weight of not less than 5,000 and fluorine content of not less than 10% by weight and is soluble in water in an amount of at least 0.1% by weight at 25° C. and the surface tension of which is not more than 50 dyn/cm when measured on 0.1 to 5.0% by weight aqueous solution at 25° C. has excellent fire-extinguishing performance on fire of cooking oil, particularly of frying oil.

25 Claims, No Drawings

AQUEOUS FIRE-EXTINGUISHING COMPOSITION

The present invention relates to an aqueous fire-extinguishing composition. More particularly, it relates to an aqueous fire-extinguishing composition comprising a water-soluble high molecular compound having a fluoroalkyl group and a water-solubilizable group.

U.S. Pat. No. 4,303,534 discloses and claims a foam fire-extinguishing composition comprising a foam fire-extinguishing agent and a certain specific water-soluble high molecular compound having a fluoroalkyl group and a water-solubilizable group, the foam fire-extinguishing agent being a fluorine-containing or fluorine-free surfactant or a partially hydrolyzed protein-containing fire-extinguishing agent. This foam fire-extinguishing composition can form stable foams on polar organic solvents and also forms heat-resistant foams on petroleum solvents or polar organic solvents. The disclosure of the above-mentioned patent is hereby incorporated by reference.

However, there has been known no effective extinguishing method against the fire of cooking oil, particularly of frying oil such as rapeseed oil since the heated oil repulses any conventional fire-extinguishing agent so that the agent cannot work effectively.

As a result of extensive study, it has now been found that an aqueous composition containing the water-soluble high molecular compound has excellent fire-extinguishing performance on the fire of cooking oil, particularly of frying oil since the aqueous composition may reduce repulsion between the oil and an aqueous solvent, and that reignition after the fire has been extinguished is minimized.

According to the present invention, there is provided an aqueous fire-extinguishing composition comprising an aqueous solvent and a water-soluble high molecular compound which contains a fuoroalkyl group and a water-solubilizable group, has an average molecular weight of not less than 5,000 and fluorine content of not less than 10% by weight and is soluble in water in an amount of at least 0.1% by weight at 25° C. and the surface tension of which is not more than 50 dyn/cm when measured on 0.1 to 5.0% by weight aqueous solution at 25° C.

The water-soluble high molecular compound is required to have an average molecular weight of not less than 5,000, preferably not less than 10,000. When the average molecular weight is less than 5,000, an effective layer cannot be formed on the surface of the oil and thus the repulsion of the oil cannot be reduced.

The water-soluble high molecular compound is also required to have a fluorine content of not less than 10% by weight, preferably not less than 15% by weight. When the fluorine content is less than 10% by weight, the technical effect inherent to the fluoroalkyl group is not exerted. Preferably, the fluoroalkyl group has 4 to 20 carbon atoms.

The water-soluble high molecular compound is further required to be soluble in water at 25° C. in an amount of not less than 0.1% by weight, preferably not less than 0.5% by weight. Generally, a compound having a larger number of fluoroalkyl groups in the molecular exerts a higher extinguishing performance but shows a smaller solubility in water. Therefore, it is usually necessary for the water-soluble high molecular compound to have one or more water-solubilizable groups per each fluoroalkyl group, although the proportion of the contents of the fluoroalkyl group and of the water-soluble group may be appropriately decided. Examples of the water-solubilizable group are hydroxyl; 2-oxopyrrolidinyl; carboxyl, phosphate, sulfate and sulfo, in a free or salt form (eg. alkali metal, amine or ammonium salts); amino in a free or salt form (eg. organic acid and inorganic acid salts), polyoxyalkylene in a free or salt form, etc.

Moreover, the water-soluble high molecular compound is not required to produce extreme depression of surface therein when dissolved in water. Any one showing a surface tension of not more than 50 dyn/cm, preferably not more than 40 dyn/cm (determined on 0.1 to 5.0% aqueous solution at 25° C.) can be satisfactorily used. Any one showing higher than 50 dyn/cm cannot spread thoroughly on the surface of the oil and thus the extinguishing effect of the composition would not be satisfactory.

Specific examples of the water-soluble high molecular compound which can be used as the additive are as follows:

(I) Copolymers of fluoroalkyl group-containing unsaturated compounds and unsaturated compounds having a water-solubilizable group or any group convertible thereto such as (a) a copolymer between $Rf—(CH_2)_n—CH{=}CH_2$ and $CH_2{=}CHCOOH$ in a molar ratio of 1:1-10, (b) a copolymer between $Rf—CH_2CH(OH)CH_2OOCCH{=}CH_2$ and $CH_2{=}C(CH_3)COOH$ in a molar ratio of 1:1-10, (c) a copolymer between $Rf—CH_2CH_2—OOCC(CH_3){=}CH_2$ and

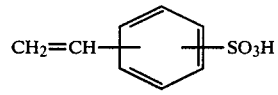

in a molar ratio of 1:1-10, (d) a copolymer between $Rf—SO_2N(C_3H_7)CH_2—CH_2OOCCH{=}CH_2$ and $CH_2{=}C(CH_3)COOCH_2CH_2OP(O)(OH)_2$ in a molar ratio of 1:1-10, (e) a copolymer between $Rf—CON(CH_3)CH_2—CH_2OOCC(CH_3){=}CH_2$ and $CH_2{=}C(CH_3)COOCH_2CH_2OP(O)(OH)_2$ in a molar ratio of 1:1-10, (f) a product obtained by hydrolysis of the ester groups in a copolymer between $Rf—CH_2OCH{=}CH_2$ and $CH_2{=}CHCOOCH_3$ in a molar ratio of 1:5-15, (g) a copolymer between $(Rf)_2CFOCH_2CH{=}CH_2$ and $CH_2{=}C(CH_3)COOCH_2CH(OH)CH_2N^{\oplus}(CH_3)_3I^{\ominus}$ in a molar ratio of 1:1-10, (h) a terpolymer of $Rf—CH_2CH(OH)CH_2OOCC(CH_3){=}CH_2$, $CH_2{=}C(CH_3)COOH$ and $CH_2{=}CHCOOH$ in a molar ratio of 1:1-5:1-5, (i) a terpolymer of $Rf—CH_2CH_2OOCCH{=}CH_2$, $CH_2{=}CHCOOH$ and $CH_2{=}C(CH_3)COOC_{18}H_{37}$ in a molar ratio of 1:1-20:1-5, or products obtained by the partial neutralization of the copolymers (a) to (d) with alkali hydroxides or amines or products obtained by the partial neutralization of the copolymer (e) or the terpolymer (i) with alkali hydroxides. In the above formulas, Rf is a fluoroalkyl group and n is an integer of 1 to 10.

(II) Fluoroalkyl group-introduced high molecular compounds having a water-solubilizable group or any group convertible thereto such as (j) a product obtained by the partial neutralization of a polymer comprising units of $$\left(CH_2CH\right)_l \quad (\text{COOH})$$

with $RfCH_2CH_2NH_2$ and an alkali hydroxide, (k) a product obtained by partial esterification of a polymer comprising units of $$\left(CH_2CH\right)_l \ (\text{COOH}) \quad \text{with } RfCH_2CH\underset{O}{\diagup\!\!\diagdown}CH_2,$$

followed by the partial neutralization with an alkali hydroxide, (l) a product obtained by the partial neutralization of a polymer comprising units of

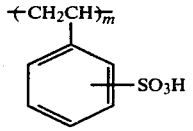

with $RfCONH(CH_2)_3N(CH_3)_2$ and an alkali hydroxide, (m) a product obtained by reacting a copolymer between $CH_2{=}C(CH_3)COOK$ and $$CH_2{=}CHCOOCH_2CH\underset{O}{\diagup\!\!\diagdown}CH_2$$

in a molar ratio of 1–10:1 with RfCOOH or (n) a product obtained by the partial neutralization of a polymer comprising units of $$\left(CH_2C(CH_3)\right)_p \ (\text{COO}(CH_2)_3NH_2)$$

with $RfCH_2CH(OH)CH_2OP(O)(OH)_2$ and acetic acid. In the above formulas, Rf is a fluoroalkyl group, and l, m and p are each a positive integer.

(III) Polymers obtained by condensation polymerization, addition polymerization or ring opening polymerization between fluoroalkyl group-containing compounds and water-solubilizable group-containing compounds such as (o) a product obtained by condensation polymerization between $$Rf{-}CH_2CH_2OCH\begin{matrix}\diagup CH_2CH_2NH_2\\ \diagdown CH_2CH_2NH_2\end{matrix} \quad \text{and} \quad \begin{matrix}HOOCCH_2\diagdown\\ \diagup CHSO_3Na\\ HOOC\end{matrix}$$

in a molar ratio of 1:1 or (p) a product obtained by addition polymerization between $$RfCH_2CH_2OCH\begin{matrix}\diagup CH_2CH_2NCO\\ \diagdown CH_2CH_2NCO\end{matrix} \quad \text{and} \quad \begin{matrix}HOCH_2CH_2\diagdown\\ \diagup CHSO_3Na\\ HOCH_2\end{matrix}$$

in a molar ratio of 1:1, etc.

Among them, the compounds belonging to (I) can be produced by a conventional polymerization procedure such as solution polymerization, emulsion polymerization or bulk polymerization. Regardless of the kind of the polymerization procedure adopted, the compounds all can be used in this invention. The compounds belonging to (II) are obtained by reacting water-soluble high molecular compounds containing no fluorine with fluorine-containing compounds according to a conventional procedure. Some of them may be produced by the homopolymerization of compounds having a fluoroalkyl group and a water-solubilizable group.

The water-soluble high molecular compound may be added to the aqueous solvent, namely water alone or water containing one or more organic solvents, in an amount of from 0.1 to 60% by weight, preferably from 1 to 20% by weight.

The organic solvent contained in the aqueous solvent enhances the solubility of the water-soluble high molecular compound in water. Usually, a water-soluble organic solvent having a boiling point of not less than 150° C. is used, specific examples of which are ethylcarbitol, diethylne glycol, etc.

If desired, the aqueous fire-extinguishing composition may contain other fluorine-free water-soluble high molecular compounds, surfactants and/or inorganic salts.

Specific examples of the fluorine-free water-soluble high molecular compounds are polyethylene glycol having a molecular weight of not less than 2,000, polyvinyl alcohol, polysodium acrylate, polyacrylic amide, a copolymer of acrylic acid and ethylene, a copolymer of maleic anhydride and methyl vinyl ether, and modified (or water-solubilized) natural gums.

The surfactant may be any fluorine-containing and fluorine-free surfactant. Their specific examples are $C_7F_{15}COONH_4$, $C_8F_{17}SO_2NHC_3H_6N^{\oplus}(CH_3)_3I^{\ominus}$, $C_8F_{17}O{-}(C_2H_4O)_{15}H$,

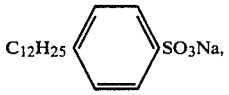

$C_{18}H_{37}COOK$, $C_{12}H_{25}N^{\oplus}(CH_3)_3Cl^{\ominus}$,

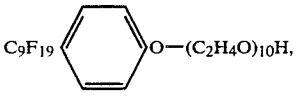

etc.

Specific examples of the inorganic salts are sodium hydrogencarbonate, ammonium phosphate, etc.

The total amount of the water-soluble high molecular compound and other optional additives is preferably not more than 60% by weight of the aqueous solvent. When the total amount is more than 60% by weight, the water content of the compound is too small to cool the oil heated at a temperature higher than its ignition point and thus the extinguishing effect of the compound is not sufficient.

The aqueous fire-extinguishing composition of the present invention may be prepared by a per se conventional method, for example by adding necessary amounts of the water-soluble high molecular compound and other additives in the aqueous solution with stirring.

The aqueous fire-extinguishing composition of the present invention may be used according to a per se conventional method, for example, by filling the composition in a resin-made container and throwing it on the burning surface of the oil, or by filling the composition in an aerosol can together with pressurized noncombustible gas and spraying the composition on the fire. Preferred examples of the noncombustible gas are dichlorofluoromethane and bromotrifluoromethane.

The present invention will be hereinafter explained further in detail by the following Examples.

EXAMPLES 1 TO 6 AND COMPARATIVE EXAMPLES 1 TO 4

An aqueous fire-extinguishing composition was prepared by adding water, the following water-soluble high molecular compound and other additives (if appropriate) as shown in the Table in a predetermined proportion in a beaker and stirring the mixture to obtain a homogeneous mixture. The thus prepared mixture (20 g) was filled in a polyethylene-made bag and sealed.

For comparison, conventional fire-extinguishing agents (Comparative Examples 1 to 4) were also used.

The surface tension of the water-soluble high molecular compound was measured on a 0.1% by weight aqueous solution.

Water-soluble high molecular compounds

Examples 1 and 2

A product obtained by the neutralization of a terpolymer of $C_9F_{19}CH_2CH(OH)CH_2OOCCH{=}CH_2$, $CH_2{=}CHCOOH$ and $CH_3(OCH_2CH_2)_9OOCC(CH_3){=}CH_2$ in a molar ratio of 1:1:0.1 with sodium hydroxide. Fluorine content, 49% by weight; molecular weight, 8,500, surface tention, 28 dyn/cm.

Examples 3 and 4

A product obtained by the neutralization of a copolymer of $C_8F_{17}C_2H_4OOCCH{=}CH_2$ and $CH_2{=}C(CH_3)COOC_2H_4O{-}P(O)(OH)_2$ in a molar ratio of 1:2.5 with sodium hydroxide. Fluorine content, 28% by weight; molecular weight, 10,500, surface tention, 32 dyn/cm.

Example 5

A product obtained by the neutralization of 10% by mol of

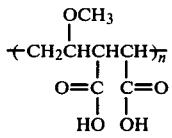

with $C_{13}F_{17}C_2H_4NH_4$ followed by neutralization with aqueous ammonia. Fluorine content, 29.5% by weight; molecular weight, 25,000, surface tention, 42 dyn/cm.

Example 6

A product obtained by the neutralization of a terpolymer of $C_2F_5SO_2N(C_3H_7)C_2H_4OOCCH{=}CH_2$,

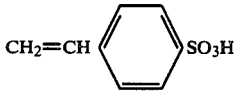

$H(OCH_2CH_2)_{10}OOCH{=}CH_2$ in a molar ratio of 1:1:2 with potassium hydroxide. Fluorine content, 15.5% by weight; molecular weight, 7,300, surface tention, 38 dyn/cm.

A fire extinguishing test was effected as follows:

In an aluminum-made pan (inner diameter of 160 mm and height of 90 mm) equipped with a thermocouple, rapeseed oil was added and heated on a propane burner until the oil naturally ignited. A measuring board was set behind the pan to measure the height of the flame. Timing was started when the oil ignited at a natural ignition temperature of about 380° C., and after 30 seconds, a fire-extinguishing bag containing 20 g of the fire-extinguishing composition was touched on the firing surface of the oil by hanging the bag from one end of a metal rod. The height of the flame just before the application of fire-extinguishing composition was 30 cm. As soon as the composition spread over the surface of the oil, the flame enlarged for a moment due to the repulsion of the oil. The maximum height of the flame was observed by means of the measuring board.

A period of time from the application of the fire-extinguishing composition to the extinguishing of the fire was measured as extinguishing time. When the fire was extinguished completely, the propane gas was turned off, and then the pan was kept standing for 2 minutes to observe reignition.

The results are shown in the Table.

TABLE

| | Composition (wt %) | Height of flame (cm) | Extinguishing Time (min.) | Reignition |
|---|---|---|---|---|
| Example 1 | Water-soluble high molecular compound (10)<br>Water (90) | 80 | 2 | No |
| Example 2 | Water-soluble high molecular compound (10)<br>Polyethylene glycol (0.5) (M.W. 80,000)<br>Sodium dodecyl benzene sulfate (2)<br>Fluorine-containing*1 surfactant (1)<br>Water (88.5) | 60 | 3 | No |
| Example 3 | Water-soluble high molecular compound (5)<br>Water (95) | 100 | 3 | No |
| Example 4 | Water-soluble high molecular compound (5)<br>Copolymer of maleic | 90 | 3 | No |

TABLE-continued

| | Composition (wt %) | Height of flame (cm) | Extinguishing Time (min.) | Reignition |
|---|---|---|---|---|
| | anhydride/methyl vinyl ether (3) Sodium laurylsulfate (0.5) Water (91.5) | | | |
| Example 5 | Water-soluble high molecular compound (20) Water (80) | 70 | 4 | No |
| Example 6 | Water-soluble high molecular compound (10) Water (90) | 90 | 2 | No |
| Comparative Example 1 | Protein foam fire extinguishing agent*2 (100) | 280 | Not extinguished | — |
| Comparative Example 2 | Lightwater ATC (100) (3M) | 140 | 5 | No |
| Comparative Example 3 | Copolymer of maleic anhydride/methyl vinyl ether (10) Water (90) | 290 | 15 | Yes |
| Comparative Example 4 | Modified gum arabic (20) Water (80) | 260 | Not extinguished | — |

Note:
*1 $C_9F_{19}CH_2CH(OH)CH_2O(C_2H_4)_9CH_3$
*2 6%-type (manufactured by Hatsuta Seisakusyo)

What is claimed is:

1. An aqueous non-foaming cooking oil fire-extinguishing composition comprising an aqueous solvent and a water-soluble high molecular compound, said water-soluble high molecular compound containing a fluoroalkyl group and one or more water-solubilizable groups per each fluoroalkyl group; having an average molecular weight of not less than 5000 and fluorine content of not less than 15% by weight; being soluble in water in an amount of at least 0.1% by weight of 25° C.; and the surface tension of which is not more than 50 dyn/cm when measured on 0.1 to 5.0% by weight aqueous solution at 25° C.; and the amount of the water-soluble high molecular compound being from 0.1 to 60% by weight on the basis of the weight of said aqueous solvent.

2. The aqueous non-foaming fire-extinguishing composition according to claim 1, wherein the water-solubilizable group borne on the water-soluble high molecular compound is one selected from the group consisting of hydroxyl; 2-oxopyrrolidinyl; carboxyl, phosphate, sulfate and sulfo, in a free or salt form; amino in a free or salt form, and polyoxyalkylene in a free or salt form.

3. The aqueous non-foaming fire-extinguishing composition according to claim 1, wherein the average molecular weight of the water-soluble high molecular compound is not less than 10,000.

4. The aqueous non-foaming fire-extinguishing composition according to claim 1, wherein the fluorine content of the water-soluble high molecular compound is not less than 15% by weight.

5. The aqueous non-foaming fire-extinguishing composition according to claim 1, wherein the water-soluble high molecular compound is soluble in water at 25° C. in an amount less than 0.5% by weight.

6. The aqueous non-foaming fire-extinguishing composition according to claim 1, wherein the surface tension of the water-soluble high molecular compound is not more than 40 dyn/cm.

7. The aqueous non-foaming fire-extinguishing composition according to claim 1, wherein the fluoroalkyl group borne on the water-soluble high molecular compound has 4 to 20 carbon atoms.

8. An aqueous non-foaming fire-extinguishing composition adapted for extinguishing cooking oil fires which consists essentially of an aqueous solvent and a water-soluble high molecular compound, said water-soluble high molecular compound containing a fluoroalkyl group and one or more water-solubilizable groups per each fluoroalkyl group; having an average molecular weight of not less than 5000 and fluorine content of not less than 15% by weight; being soluble in water in an amount of at least 0.1% by weight at 25° C.; and the surface tension of which is not more than 50 dyn/cm when measured on 0.1 to 5.0% by weight aqueous solution at 25° C.; and the amount of the water-soluble high molecular compound being from 0.1 to 60% by weight on the basis of the weight of said aqueous solvent.

9. An aqueous fire-extinguishing composition according to claim 8, wherein the water-solubilizable group borne on the water-soluble high molecular compound is one selected from the group consisting of hydroxyl; 2-oxopyrrolidinyl; carboxyl, phosphate, sulfate and sulfo, in a free or salt form; amino in a free or salt form, and polyoxyalkylene in a free or salt form.

10. An aqueous fire-extinguishing composition according to claim 8, wherein the average molecular weight of the water-soluble high molecular compound is not less than 10,000.

11. An aqueous fire-extinguishing composition according to claim 8, wherein the fluoroalkyl group borne on the water-soluble high molecular compound has 4 to 20 carbon atoms.

12. The aqueous non-foaming fire-extinguishing composition according to claim 8, wherein the fluorine content of the water-soluble high molecular compound is not less than 15% by weight.

13. The aqueous non-foaming fire-extinguishing composition of claim 8, wherein the water-soluble high molecular compound is soluble in water at 25° C. in an amount less than 0.5% by weight.

14. The aqueous non-foaming fire-extinguishing composition according to claim 8, wherein the surface tension of the water-soluble high molecular compound is not more than 40 dyn/cm.

15. The aqueous non-foaming fire-extinguishing composition according to claim 8, which further contains a fluorine-free water-soluble high molecular compound selected from the group consisting of polyethylene glycol having a molecular weight of not less than 2000, polyvinyl alcohol, polysodium acrylate, polyacrylic amide, a copolymer of acrylic acid and ethylene, a copolymer of maleic anhydride and methyl vinyl ether, and modified (or water-solubilized) natural gums.

16. The aqueous non-foaming fire-extinguishing composition according to claim 8, which further contains a surfactant selected from the group consisting of $C_7F_{15}COONH_4$, $C_8F_{17}SO_2NHC_3H_6N^{\oplus}(CH_3)_3I^{\ominus}$, $C_8F_{17}O—(C_2H_4O)_{15}H$,

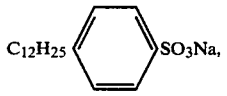

$C_{18}H_{37}COOK$, $C_{12}H_{25}N^{\oplus}(CH_3)_3Cl^{\ominus}$,

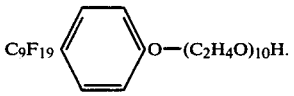

17. The aqueous non-foaming fire-extinguishing composition of claim 8, which further contains an inorganic salt selected from the group consisting of sodium hydrogencarbonate and ammonium phosphate.

18. The aqueous non-foaming fire-extinguishing composition according to claim 8, which consists of the aqueous solvent and the water-soluble high molecular compound.

19. A method for extinguishing cooking oil fires comprising applying to said fire an aqueous non-foaming fire-extinguishing composition adapted for extinguishing cooking oil fires comprising an aqueous solvent and a water-soluble high molecular compound, said water-soluble high molecular compound containing a fluoroalkyl group and one or more water-solubilizable groups per each fluoroalkyl group; having an average molecular weight of not less than 5000 and fluorine content of not less than 15% by weight; being soluble in water in an amount of at least 0.1% by weight at 25° C.; and the surface tension of which is not more than 50 dyn/cm when measured on 0.1 to 5.0% by weight aqueous solution at 25° C.; and the amount of said water-soluble high molecular compound being from 0.1 to 60% by weight on the basis of the weight of said aqueous solvent.

20. The method as recited in claim 19, wherein the water-solubilizable group borne on the water-soluble high molecular compound is one selected from the group consisting of hydroxyl; 2-oxopyrrolidinyl; carboxyl, phosphate, sulfate and sulfo, in a free or salt form; amino in a free or salt form, and polyoxyalkylene in a free or salt form.

21. The method as recited in claim 19, wherein the average molecular weight of the water-soluble high molecular compound is not less than 10,000.

22. The method as recited in claim 19, wherein the fluorine content of the water-soluble high molecular compound is not less than 15% by weight.

23. The method as recited in claim 19, wherein the water-soluble high molecular compound is soluble in water at 25° C. in an amount less than 0.5% by weight.

24. The method as recited in claim 19, wherein the surface tension of the water-soluble high molecular compound is not more than 40 dyn/cm.

25. The method as recited in claim 19, wherein the fluoroalkyl group borne on the water-soluble high molecular compound has 4 to 20 carbon atoms.

* * * * *